United States Patent [19]

Katoh et al.

[11] 3,935,781

[45] Feb. 3, 1976

[54] VOICE PRESETTING SYSTEM IN ELECTRONIC MUSICAL INSTRUMENTS

[75] Inventors: Hirokazu Katoh; Akinori Endo, both of Hamamatsu, Japan

[73] Assignee: Nippon Gakki Seizo Kabushiki Kaisha, Japan

[22] Filed: July 30, 1974

[21] Appl. No.: 493,650

[30] Foreign Application Priority Data

Aug. 3, 1973 Japan ..... 48-86777

[52] U.S. Cl. ..... 84/1.11; 84/1.19

[51] Int. Cl.² ..... G10H 1/02

[58] Field of Search.. 84/1.01, 1.03, 115, 1.09–1.11, 84/1.19, 1.24, 1.27

[56] References Cited

UNITED STATES PATENTS

| | | | |
|---|---|---|---|
| 3,515,792 | 6/1970 | Deutsch | 84/1.03 |
| 3,610,799 | 10/1971 | Watson | 84/1.01 |
| 3,733,593 | 5/1973 | Molnar | 84/1.01 X |
| 3,755,608 | 8/1973 | Deutsch | 84/1.01 |
| 3,809,789 | 5/1974 | Deutsch | 84/1.01 |
| 3,821,712 | 6/1974 | Wetzel | 84/1.01 X |
| 3,821,714 | 6/1974 | Tomisawa et al. | 84/1.01 X |
| 3,823,390 | 7/1974 | Tomisawa et al. | 84/1.01 X |

*Primary Examiner*—L. T. Hix
*Assistant Examiner*—Stanley J. Witkowski
*Attorney, Agent, or Firm*—Robert E. Burns; Emmanuel J. Lobato; Bruce L. Adams

[57] ABSTRACT

Tone lever switches deliver respective digital information signals each representing the manipulated state of each tone lever. A memory circuit memorizes plural sets of the information signals. A write/read control circuit determines whether the memory circuit memorizes the digital information signals from the tone lever switches or it delivers out the memorized digital information signals. A tone color control circuit controls the respective intensities of the tone signals of respective voices in accordance with the information signals read out from the memory circuit.

5 Claims, 5 Drawing Figures

VOICE PRESETTING SYSTEM IN ELECTRONIC MUSICAL INSTRUMENTS

BACKGROUND OF THE INVENTION

This invention relates to the improvement of a voice presetting system in electronic musical instruments such as electronic organs.

In this specification, the term "musical tone signals" as herein used is intended to designate all of the signals related to the formation of sounds or musical tones produced by electronic musical instruments. These signals include not only the signals having spectra, but also original tone signals, modualated tone signals and signals switched by keys. The term "electronic musical instruments" includes for instance electrophonic guitars also.

In general, an electronic instrument is provided with a voice presetting system which is adapted to preset the rates of controlling a plurality of musical tone signals to be mixed and produced, according to the data representing the displacements of a plurality of movable operating members provided for the musical tone signals. For instance, rates in attenuating musical tone signals representing wood, string, flute tones are preset by turning, or displacing in angle, the respective tone levers (manipulating knobs), and the musical tone signals are controlled to the attenuation rates thus preset during the performance, thereby to be mixed and produced as resultant composite musical tones.

In conventional voice presetting systems of the type described above, in addition to tone volume controls provided on a control panel, a number of tone levers are provided on a voice presetting board, and potentiometers whose voltage division ratios are defined by the manipulated positions of the tone levers are connected by switching means to the output sides of a plurality of tone coloring filters (formant circuits) provided at the preceding stage of a musical tone signal mixing circuit.

If it is assumed that rates of attenuating three musical tone signals X, Y and Z are changed stepwise to $x_1 - x_4$, $y_1 - y_4$ and $z_1 - z_4$, respectively, the voice presetting operation is carried out to have, for instance, a first set of attenuation rates $(x_1, y_2, z_4)$, a second set $(x_4, y_3, z_1)$ and so forth. Each of these sets of attenuation rates defines the voltage division ratios of the plurality of potentiometers, that is, the attenuation rates of the respective tone color signals. These potentiometers are connected to the paths of the musical tone signals by the switching means operated by voice presetting operation selecting switches, as a result of which the musical tone signals are controlled and mixed according to the attenuation rates thus preset to obtain the desired voices.

However, this conventional voice presetting system is disadvantageous in the following:

1. The conventional system needs a plurality of rows of tone levers and accordingly a number of tone levers, in order to provide plural sets of manipulated states of the tone levers. Accordingly, the lever presetting operation is rather troublesome, and the larger area of the panel is occupied by the tone levers, this causes an obstruction in making the voice presetting system smaller in size.

2. The conventional system necessitates switching contacts whose number is equal to the number of musical tone signals to be controlled times the number of tone levers to be preset, and therefore the electrical wiring is inevitably complicated, which leads to an obstruction in manufacturing the voice presetting system smaller in size and higher in reliability.

3. With the movable members such as e.g. tone levers whose number is equal to the number of musical tone signals to be controlled thereby, the number of the preset combination, or set of control rates, is only one. Accordingly, increasing the number of the sets of control rates cannot be attained without greatly increasing the number of tone levers and the switching means. However, the increase of the number of these elements is naturally limited to some extent. Therefore, performances on the electronic musical instrument having the conventional system are liable to be insufficient in musical variation.

SUMMARY OF THE INVENTION

Accordingly, a primary object of this invention is to provide a novel voice presetting system in electronic musical instruments in which all of the difficulties described above accompanying conventional voice presetting systems have been overcome.

More specifically, an object of the invention is to provide a voice presetting system in electronic musical instruments in which plural sets of musical tone signal control rates are preset by movable operating members whose number is equal to the number of musical tone signals to be controlled thereby.

Another object of the invention is to provide a voice presetting system in electronic musical instruments which is smaller in size and higher in reliability.

A further object of the invention is to provide a voice presetting system in electronic musical instruments which contributes to the production of clear tone colors not including induction noises.

The foregoing objects and other objects of this invention will become more apparent from the following detailed description and the appended claims in conjunction with the accompanying drawings, in which like parts are designated by like reference numerals or characters.

DETAILED DESCRIPTION OF THE INVENTION

Figure 1:
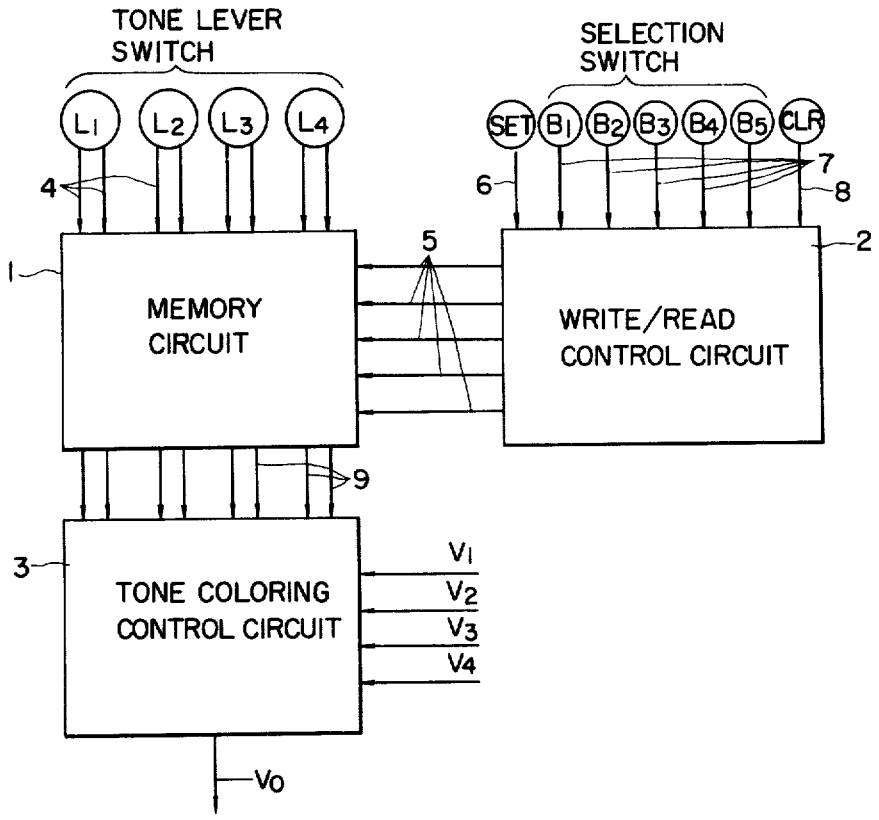
FIG. 1 is a block diagram showing one example of a voice presetting system in an electronic musical instrument according to this invention.

One example of a voice presetting system in electronic musical instruments according to this invention is shown in FIG. 1 which comprises a memory circuit 1, a write and read control 2, and a tone coloring control circuit 3.

The memory circuit 1 consists of a plurality of (five in this case) memory subsections and stores binary code signals 4 representing the manipulated states of tone lever switches $L_1$, $L_2$, $L_3$ and $L_4$ each having a binary encoder which will be described later in detail.

The write and read control circuit 2 is connected to a mode setting switch SET comprising an alternate switch (reversible switch), selection switches $B_1$, $B_2$, $B_3$, $B_4$ and $B_5$ each comprising an individual selector switch, and a clear switch CLR for producing a clearing signal 8 to switch a performance mode from a voice presetting mode to a manual mode. The switch SET is adapted to produce a mode switching signal 6 for changing the control mode on the memory circuit 1 from a write mode to a read mode or vice versa, while the selection switches $B_1$ –$B_5$ are adapted to produce selection signals 7 for selecting the memory subsections in the memory circuit 1. By receiving these signals 6, 7 and 8, the control circuit 2 produces control signals 5 which are employed to control the write and read operation of the memory circuit 1.

The tone coloring control circuit 3 receives binary code signals 9 read out of the memory circuit 1, and for instance attenuates musical tone signal inputs $V_1$, $V_2$, $V_3$ and $V_4$ at predetermined degrees in response to the binary signals 9 thus received, thereby to produce a mixed musical tone signal Vo. This signal Vo thus produced is amplified by a power amplifier (not shown) to produce a musical tone.

The musical tone signals $V_1$ through $V_4$ are, for instance, ones representing wood, string, flute and oboe voices, respectively. Preferably, the switches SET, $B_1$ through $B_5$ and CLR are solid state switches such as pressure sensitive switches which employ a semiconductor.

The system shown in FIG. 1 is divided roughly into two sections: a voice presetting information signal forming section which is provided with a plurality of tone levers each having an encoder (hereinafter referred to as tone lever switch assemblies when applicable), for forming voice presetting information signals consisting of digital (binary) signals corresponding to the displacements of the levers; and a voice presetting information signal processing section for processing the voice presetting information signals.

Figure 2A:
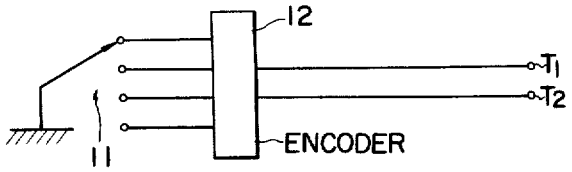
FIG. 2*a* is an explanatory diagram showing a tone lever switch which is employed in the system shown in FIG. 1.
Figure 2B:
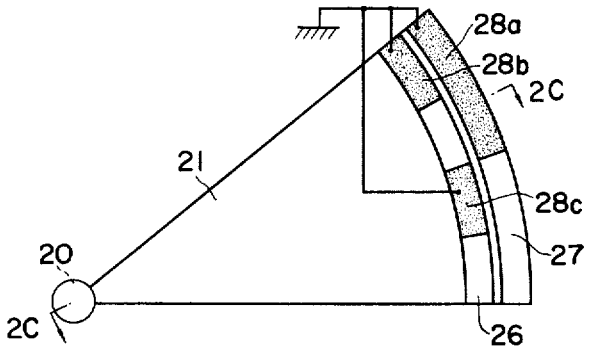
FIG. 2*b* shows a side view of a portion of the actual embodiment of the tone lever switch.
Figure 2C:
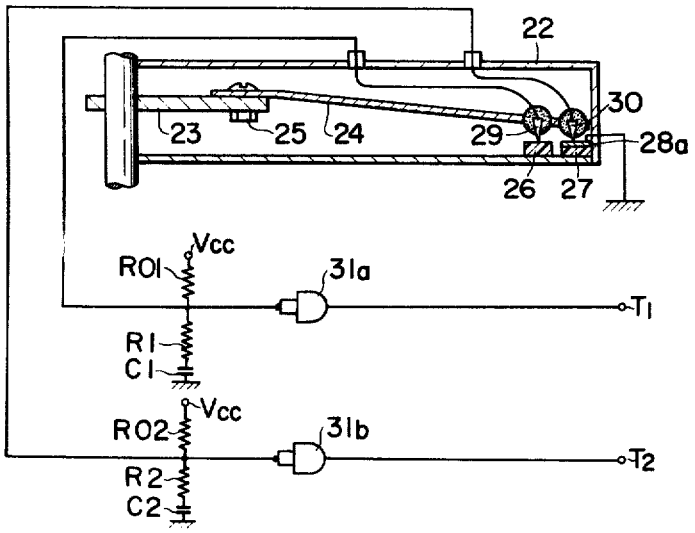
FIG. 2*c* shows a cross sectional view taken along the line IIC—IIC of FIG. 2*b* and associated circuits.

FIGS. 2*a*, 2*b* and 2*c* show one example of the tone lever switch assemblies for forming the voice presetting information signals.

As is shown in FIG. 2*a* by schematic principle, the tone lever switch assembly is considered to be provided with a rotary switch 11 having four contacts which is operated by a tone lever having four positions, and an encoder 12 operating to convert the four switching conditions (manipulated states) of the rotary switch 11 into 2-bit binary code signals.

More specifically and actually, the tone lever switch assembly, as illustrated in FIGS. 2*b* and 2*c*, comprises: a shaft 20 which is rotated by the tone lever; a sector-shaped plate 21 to which the shaft 11 is rotatably secured; a cover member 22 covering the plate 21; arc-shaped insulating members 26 and 27 which are disposed concentrically on the plate 21, and electrically conductive layers 28*a*, 28*b* and 28*c* provided on the insulating members and grounded. The insulating member 26 and the conductive layers 28*b* and 28*c* form a first encoding surface, while the insulating member 27 and the conductive layer 28*a* form a second encoding surface.

The shaft 20 has a fixed member 23 fixed thereto and a support member 24 fixed to the member 23 with bolts and nuts 25. The support member 24 is provided with slide contacts 29 and 30 at its end portion so that the slide contacts 29 and 30 are slided along the first and the second encoding surface, respectively, as the shaft 20 is turned. To the slide contacts 29 and 30, predetermined potentials are applied through resistors $RO_1$ and $RO_2$ from a d.c. source Vcc. The contacts 29 and 30 are connected to input terminals of AND gates 31*a* and 31*b*, respectively. To the input terminals of the AND gates, a series circuit of a resistor $R_1$ and a capacitor $C_1$ and a series circuit of a resistor $R_2$ and a capacitor $C_2$ are connected, respectively, in order to eliminate noises which may be produced in sliding the slide contacts, that is, to prevent the occurrence of chattering.

When both of the contacts 29 and 30 are in contact with the conductive layers, the first logical level (for instance "0") appears at both of the output terminals $T_1$ and $T_2$ of the AND gates 31*a* and 31*b*. When the contacts 29 and 30 are in contact with the insulating members, the second logical level (for instance "1") appears at both of the output terminals $T_1$ and $T_2$. Furthermore, when one of the contacts is on the conductive layer while the other is on the insulating member, logical levels at the terminals $T_1$ and $T_2$ are different from each other. For instance, when the contact 29 is on the conductive layer while the contact 30 is on the insulating layer, the terminal $T_1$ is at the "0" level and the terminal $T_2$ is at the "1" level.

In the tone lever switch assembly thus organized, the shaft 20 is turned by the tone lever causing the slide contacts 29 and 30 to slide along the first and the second surface thereby to make four angular displacements stepwise. These angular displacements are represented by 2-bit binary signals which are obtained at the output terminals $T_1$ and $T_2$, as was described above.

The system shown in FIG. 1 is provided with four tone lever switches $L_1$ through $L_4$ respectively for the musical tone signals $V_1$ through $V_4$ to be controlled, so that rates of controlling (attenuating) of the musical tone signals are set by converting the displacements of the respective tone levers into the 2-bit binary signals. It goes without saying that the voice presetting information signal consisting of these 2-bit binary signals can be changed by changing the switching positions of the tone lever switches.

Figure 3:
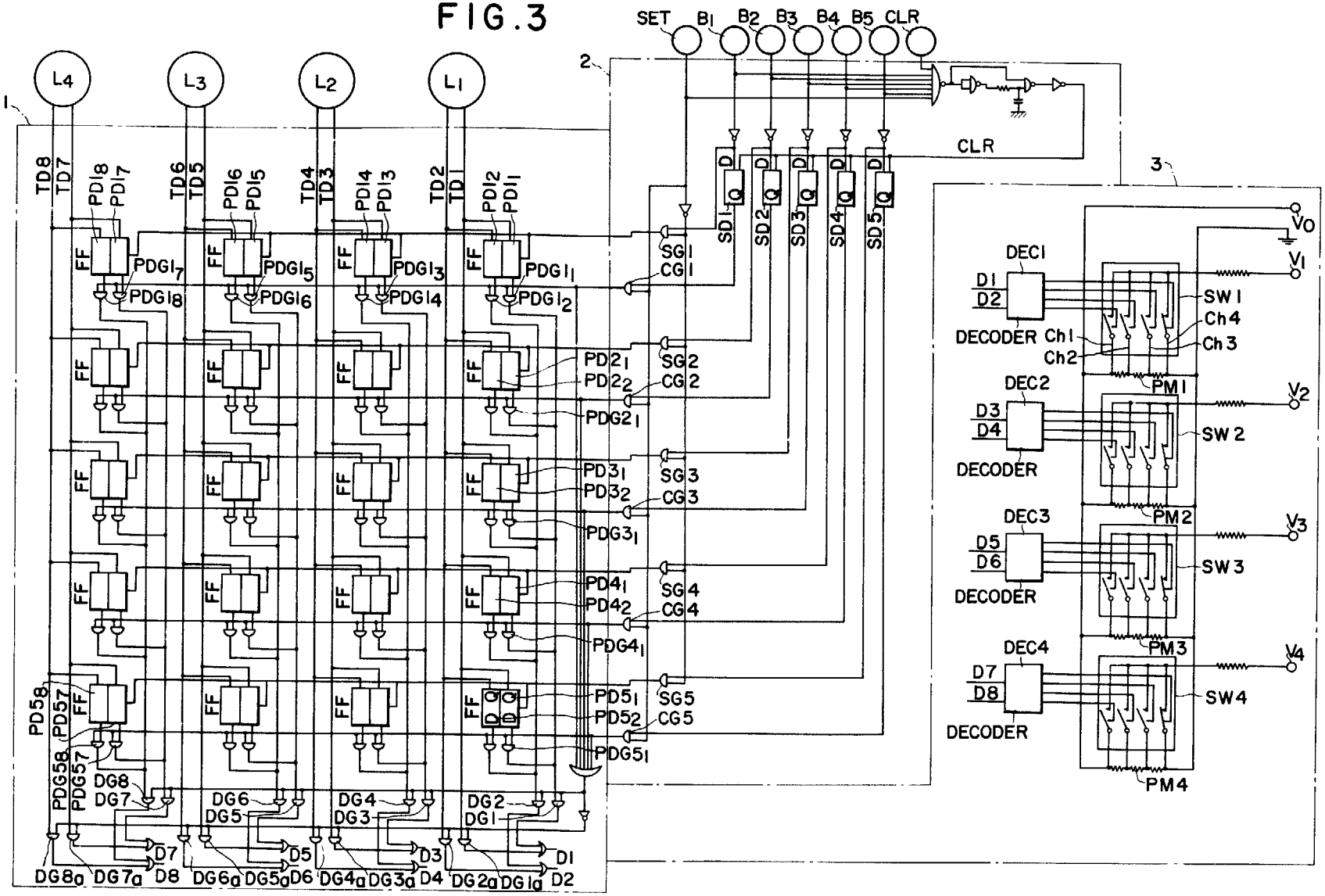
FIG. 3 is a schematic circuit diagram, with partly block diagrams, of a voice presetting information signal processing section employed in the system shown in FIG. 1.

The voice presetting information signal processing section will now be described referring to FIG. 3, in which different voice presetting information signals indicating different control rates described above are written in and read out to control the tone coloring operations.

The memory circuit 1 comprises a flip-flop matrix $PD1_1$ –$PD5_8$ for storing five sets (kinds) of four two-bit binary signals from the tone lever switches $L_1$ –$L_4$ through signal lines $TD_1$ –$TD_8$, and AND gates $PDG1_1$ –$PDG5_8$ which are provided corresponding to the number of the flip-flops, for selectively reading out the contents of the flip-flops. The number of the flip-flops or the AND gates is equal to the product of the number of the tone lever switches and the number of the selection switches.

The write and read control circuit 2 comprises latch circuits $SD_1$ through $SD_5$, and in response to the signals from the switches SET, $B_1$ through $B_5$ and CLR, controls the operation of the memory circuit 1 with the aid of control signals such as writing clock signals and reading level signals.

The tone coloring control circuits 3 comprises: four control switch circuits $SW_1$ through $SW_4$ which receive four musical tone signals $V_1$ –$V_4$, respectively, and are controlled respectively in response to the outputs of decoders $DEC_1$ through $DEC_4$; potentiometers $PM_1$ through $PM_4$ each of which has one terminal connected to an output terminal Vo of the mixed musical tone signal and taps connected to switching channels $ch_1$ through $ch_4$. The control circuit 3 thus organized, in response to the voice presetting information signal consisting of the binary signals $D_1$ through $D_8$ which are read out of the memory circuit 1 by the control circuit 2, operates to control the musical tone signals $V_1$ through $V_4$ according to the control (attenuation) rate indicated by the information signal, thereby to produce a mixed output of these signals $V_1$ through $V_4$.

The control switch circuits $SW_1$ through $SW_4$ may be embodied as a well-known integrated circuit of transistors. Each of the decoders $DEC_1$ through $DEC_4$ is to decode the 2-bit binary signal into a signal which indicates one of the four displacements of the tone lever switch. Accordingly, a 2–4 decoder may be employed as this decoder.

The operation of the voice presetting system according to this invention will now be described referring to FIG. 3.

1. Voice Presetting Operation:

First, for setting the memory circuit in a write mode, the switch SET is turned on. As a result, a logical level 1 is applied to an input terminal of each of the AND gates $SG_1$ through $SG_5$, which are therefore opened for passing signals from the selection switches $B_1$ through $B_5$, respectively.

Under these conditions, if one of the switches $B_1$ –$B_5$, for instance the switch $B_1$ is depressed, the AND gate (set gate) $SG_1$ produces a predetermined pulse whose pulse width is equal to the time during which the switch $B_1$ is depressed. Since the output terminal of the gate $SG_1$ is connected to the clock input terminals of the flip-flops $PD1_1$ through $PD1_8$, these flip-flops are rendered ready for writing the binary signals. Accordingly, when a combination of displacements is obtained by operating the tone lever switches $L_1$ –$L_4$ and the switch $B_1$ is then depressed, the voice presetting information signal consisting of four two-bit signals which represent.

The displacement combination thus obtained is written into first memory subsection constituted by the flip-flops $PD1_1$ –$PD1_8$ through the respective signal lines $TD_1$ –$TD_8$.

By setting the switches $L_1$ –$L_4$ so as to provide different displacement combinations and operating the selection switches $B_2$ –$B_5$, different sets voice presetting information signals can be stored in the remaining memory subsections (flip-flops) in the memory circuit 1, in accordance with the designation.

It should be noted that the steps of the voice presetting operation are as follows:

1—Set the tone levers as desired.

2—Then, depress one of the selection switches $B_1$ –$B_5$.

The switch SET may be made to be in "write" position at any time, as long as it is before depressing the selection switch.

2. Preset Reading Operation:

In order to play music in the preset condition of the tone colors, first the switch SET is turned off (i.e., made to be in "read" position) by depressing it again. As a result, input terminals of AND gates (call gates) $CG_1$ through $CG_5$ are at a logical level 1, and therefore the AND gates $CG_1$ through $CG_5$ are opened for passing the Q outputs of the latch circuits $SD_1$ –$SD_5$.

Under these conditions, if one of the selection switches, for instance the switch $B_1$ is depressed, a pulse having a predetermined width is applied as an input signal to the latch circuit $SD_1$, and a pulse whose width is smaller than the predetermined width is applied to a control line CL which is connected the clock input terminals of the latch circuits $SD_1$ –$SD_5$. Accordingly, the Q outputs of these circuits $SD_1$ –$SD_5$ are at 1, 0, 0, 0 and 0 levels, respectively, while the outputs of the AND gates $CG_1$ –$CG_5$ are at 1, 0, 0, 0 and 0 levels. As a result, AND gates (data gates) $DG_1$ through $DG_8$ are opened (while AND gates $DG_{1a}$ –$DG_{8a}$ being closed) and AND gates (voice presetting data gates) $PDG1_1$ –$PDG1_8$ are opened. Accordingly, the voice presetting information signal stored in the flip-flops $PD1_1$ –$PD1_8$ is read out to the signal lines $D_1$ – $D_8$ which are connected to the decoders $DEC_1$ through $DEC_4$ respectively.

The decoders $DEC_1$ –$DEC_4$ decode the binary signal inputs applied thereto through the signal lines $D_1$ –$D_8$, and according to the displacement data of the tone levers, turn on one of the switching channels $ch_1$ –$ch_4$ in each of the control switch circuits $SW_1$ –$SW_4$. As a result, the musical tone signals $V_1$ –$V_4$ are taken out through the respective potentiometers to the attenuation rates corresponding to the displacement data of the tone levers and are produced as a mixed tone signal output from the tone coloring control circuit 3. The operation described above is also applied to the case where the switch $B_2$, $B_3$, $B_4$ or $B_5$ is depressed.

3. Mode changing Operation from the Preset Mode to the Manual Mode:

The operations of the system described in paragraphs (1) and (2) relate to the performance in connection with the presetting faculty. However, the system according to this invention can operate in the manual mode in which the tone lever switches $L_1$ –$L_4$ operated by the performer during a performance directly control the tone colors to be produced.

First, the switch CLR is depressed that is, it is turned on before the switches $B_1$ –$B_5$ are depressed, to apply a predetermined pulse to the control line CL, as a result of which all of the Q outputs of the latch circuits $SD_1$ –$SD_5$ are made to be at a 0 level. Accordingly, the outputs 0 are produced by the AND gates $CG_1$ –$CG_5$, and the AND gates $DG_1$ –$DG_8$ are closed while the AND gates $DG_{1a}$ –$DG_{8a}$ are opened, whereby the binary signals from the tone lever switches $L_1$ –$L_4$ are applied to the signal lines $D_1$ –$D_8$ through the signal line $TD_1$ –$TD_8$. Thereafter, the operation of the tone coloring control circuit 3 is carried out in the same way as described in paragraph (2).

Thus, the performer can manually adjust the displacement data of the tone levers as desired during the performance to vary the ratios of controlling the musical tone signals.

Needless to say, the memory circuit can be constituted by IC memories, core memories, magnetic card reader-writers, and so forth.

While the principles of this invention have been described above in connection with a specific embodiment, it is to be clearly understood that this description is made only by way of example and not as a limitation on the scope of invention. In other words, this invention can be applied not only to the setting of the displacement data of the tone levers by operating them manually but also to the setting of displacement data of movable members such as a pedal. Furthermore, the invention can be applied not only to the presetting in tone coloring control but also to the presetting in controlling musical effects such as a vibrato effect and a tremolo effect. In addition, the present invention can be applied not only to the presetting in the rates of attenuating the musical tone signals, but also to the presetting in the ratios of amplifying the musical tone signals and to all of the presetting in the rates of controlling the musical tone signals such as rates of varying the waveforms of the musical tone signals and rates of varying the frequency modulation degrees or amplitude modulation degrees of the musical tone signals.

Accordingly, as is apparent from the description described above, the following merits are provided by the invention.

1. The system according to this invention, unlike the conventional system, is not limited by the number of voice presetting levers or switches, and can therefore readily preset many different voice presetting information signals by increasing the storage capacity thereof. Accordingly, the system can contribute to a performance rich in variation.

2. The system can be made smaller by the use of techniques on printed circuit boards and integration circuits.

3. Since the number of mechanical components is reduced considerably in this system, troubles are scarcely caused in the system. That is, the system is higher in reliability.

4. The number of the movable members to be provided is equal to the number of the musical tone signals to be controlled, and these movable members can be used both for the voice presetting performance and for the manual performance, according to this invention. Accordingly, the present invention can eliminate the voice presetting board used for installing the voice presetting tone levers and its related components which are necessary in the conventional system, which leads to flexibility in designing the panel of an electronic musical instrument and to rendering the performer's presetting operations simpler.

5. It is unnecessary to introduce the musical tone signals to the panel of the electronic musical instrument. Therefore, clear tone colors not including induction noises can be produced.

We claim:

1. A voice presetting system for an electronic musical instrument comprising, a tone-coloring circuit means having means for receiving a plurality of musical voice signals representative of musical voices as inputs and to be delivered therefrom as outputs with tone coloring thereof varied, a memory circuit means for storing binary-coded information signals read out and applied to the tone-coloring circuit means for control of the tone-coloring circuit means for control of the tone color variations of the musical voice signals, means on said memory circuit means including binary coders for introducing manually thereinto said binary-coded information signals, a write and read control circuit means for controlling writing of binary-coded information signals and alternatively controlling read out of the binary-coded information signals applied to the tone-coloring circuit means from said memory circuit means for controlling the tone color of the musical voice signal output thereof.

2. A voice presetting system for an electronic musical instrument according to claim 1, in which said memory circuit means comprises a matrix of flip-flops for storing the binary-coded information signals, and in which said means comprising said binary coders comprises a tone lever switch manually actuated, said tone lever switch comprising a plurality of manually actuated operating members each associated with a corresponding coder, the number of manually actuated operating members being equal in number to the musical voice signals received by said tone-coloring circuit means, and means including groups of said flip-flops relating a corresponding coder and group of flip-flops to a corresponding musical voice signal.

3. A voice presetting system for an electronic musical instrument according to claim 1, in which said write and read control circuit comprises means to prepare the memory circuit means for reading in and storing the binary-coded information signals and separate means for effecting read out of the binary-coded information signals for varying the tone of the musical voice signal outputs.

4. A voice presetting system for an electronic musical instrument according to claim 1, in which said write and read control circuit comprises means for preparing the memory circuit means for applying the binary-coded information signals introduced thereinto directly as outputs of the memory circuit means.

5. A voice presetting system for an electronic musical instrument according to claim 1, in which said memory circuit means comprises a plurality of flip-flops arranged in a matrix configuration, said write and read control circuit comprising means to control writing of the binary-coded information signals in said flip-flops and means to control read out of the binary-coded information signals stored in said memory circuit means, and means on said write and read control circuit to prepare said memory circuit means for transmitting directly outputs the binary-coded information signals applied thereto and without storing thereof.

* * * * *